US006885141B2

(12) United States Patent
Park

(10) Patent No.: US 6,885,141 B2
(45) Date of Patent: Apr. 26, 2005

(54) SHADOW MASK HAVING SLOTTED SKIRT PORTION

(75) Inventor: Sung-Yong Park, Busan (KR)

(73) Assignee: LG. Philips Displays Korea Co. Ltd., Kyeongsangbuk-Do (KR)

( * ) Notice: Subject to any disclaimer, the term of this patent is extended or adjusted under 35 U.S.C. 154(b) by 0 days.

(21) Appl. No.: 10/404,429

(22) Filed: Apr. 2, 2003

(65) Prior Publication Data

US 2003/0214216 A1 Nov. 20, 2003

(30) Foreign Application Priority Data

May 15, 2002 (KR) ..... 10-2002-0026613
Jan. 21, 2003 (KR) ..... 10-2003-0004061

(51) Int. Cl.[7] ..... H01J 29/80; H01J 9/236

(52) U.S. Cl. ..... 313/404; 313/402; 313/405; 313/406; 313/407; 313/408; 445/30

(58) Field of Search ..... 313/402, 404, 313/407; 445/30

(56) References Cited

U.S. PATENT DOCUMENTS 6,051,918 A * 4/2000 Hayashi et al. ..... 313/407
6,552,482 B2 * 4/2003 Ito et al. ..... 313/407
6,559,585 B2 * 5/2003 Murai et al. ..... 313/402

FOREIGN PATENT DOCUMENTS

KR 2002-0055409 A 7/2002
KR 2002-0068932 A 8/2002

* cited by examiner

*Primary Examiner*—Nimeshkumar D. Patel
*Assistant Examiner*—Matt Hodges
(74) *Attorney, Agent, or Firm*—Birch, Stewart, Kolasch & Birch, LLP

(57) ABSTRACT

A cathode ray tube comprises a panel; a funnel engaged to the panel for forming a vacuous space; and a shadow mask supported in the cathode ray tube by being fixed to a mask frame and including an effective surface having a plurality of electron beam passing holes at a center thereof, an ineffective surface formed at a periphery of the effective surface and not having the electron beam passing holes and a skirt portion extended from the ineffective surface towards a vertical direction thereof and welded to the mask frame. In the cathode ray tube, a slot of a predetermined size is formed between welding points by which the skirt portion is welded to the mask frame, and a height of the slot from an end of the skirt portion is higher than a height of the welding points, thereby reducing a doming effect of the shadow mask, reducing a mis-landing which the electron beam does not land to a precise landing point, and thus preventing a color purity of a screen from being deteriorated.

10 Claims, 7 Drawing Sheets

SHADOW MASK HAVING SLOTTED SKIRT PORTION

BACKGROUND OF THE INVENTION

1. Field of the Invention

The present invention relates to a cathode ray tube, and more particularly, to a cathode ray tube to reduce a doming effect of a shadow mask which causes a color purity of a screen to be deteriorated.

2. Description of the Background Art

Generally, a cathode ray tube is a device for converting an electric signal into an electron beam and emitting the electron beam to a fluorescent surface to realize a screen. Such a cathode ray tube is widely used since a display quality for the cost of the cathode ray tube is excellent.

The cathode ray tube will be explained with reference to attached drawings.

FIG. 1 is a schematic view showing one example of the cathode ray tube.

As shown in FIG. 1, the cathode ray tube comprises: a panel 3 of a front glass formed to have a flat outer surface and an inner surface of a predetermined curvature; a funnel 2 of a rear glass engaged to the panel 3 for forming a vacuum space; a fluorescent surface 13 deposited on an inner side surface of the panel 3 as a luminant; an electron gun 6 for emitting an electron beam which illuminates the fluorescent surface 13; a deflection yoke 7 mounted at an outer circumferential surface of the funnel 2 with a predetermined interval for deflecting the electron beam 5 to the fluorescent surface 13; a shadow mask 8 installed with a constant interval from the fluorescent surface 13; a mask frame 9 for fixing and supporting the shadow mask 8; and an inner shield 10 extending from the panel 3 to the funnel 2 for shielding external terrestrial magnetism in order to prevent color purity from being deteriorated by the magnetism.

Also, a spring supporter 14 where a supporting spring 11 which supports the mask frame 9 to the panel elastically is fixed at the inner side of the panel 3, and a reinforcing band 12 for dispersing stress generated at the panel 3 and the funnel 2 is installed at the outer circumferential surface of the panel 3.

The shadow mask 8 is a color selection device in which the electron beam 5 emitted from the electron gun 6 selectively strikes the fluorescent surface 13 deposited on the panel 3. As shown in FIG. 2, the shadow mask comprises an effective surface 17 having a plurality of electron beam passing holes 15 at a center thereof; an ineffective surface 19 formed at a periphery of the effective surface 17 and not having the electron beam passing holes 15; and a skirt portion 21 extended from the ineffective surface 19 towards a vertical direction thereof and fixed to the mask frame 9.

In the shadow mask 8, the skirt portion 21 is fixed to a side surface of the mask frame 9 by spot welding and etc., and arranged to be adjacent to the fluorescent surface 13 of the panel 3 by fixing the mask frame 9 to the panel 3.

A welding point 25 by which the shadow mask 8 is welded to the mask frame 9 is located at a middle portion of a long side portion and a short side portion of the skirt portion 21, and two slots 23 are respectively formed at outer sides of the welding point 25.

In the conventional cathode ray tube, the electron beam 5 emitted from the electron gun 6 is deflected by the deflection yoke 7, passes through the plurality of electron beam passing holes 15 formed at the shadow mask 8, is landed on the fluorescent surface 13 formed at the inner surface of the panel 3, and illuminates each luminant, thereby realizing a screen.

At this time, a part of the electron beam 5 does not pass through the electron beam passing holes 15 of the shadow mask 8 but collides with the shadow mask 8. By the collision of the electron beam 5, heat of a high temperature is generated at the shadow mask 8.

Accordingly, the shadow mask 8 is distorted by the collision heat of the electron beam 5, which is referred to as a doming effect.

The doming effect displaces the electron beam passing holes 15, which generates a mis-landing, in which the electron beam 5 does not land at a proper fluorescent surface, thereby causing a color speck on the screen. Also, since the electron beam passing holes 15 of the shadow mask 8 are very small, the color speck on the screen is generated even with only a slight doming effect.

Causes of the doming effect include heat expansion of the shadow mask 8 by collision heat of the electron beam 5 and a distortion of the shadow mask 8 by heat expansion of the mask frame 9. The doming effect of the shadow mask 8 will be explained with reference to FIGS. 3, 4, and 5.

First, the doming effect caused by heat expansion of the shadow mask 8 by collision heat of the electron beam 5, as shown in FIG. 3, is generated resulting from the shadow mask 8 being heat-expanded by heat of approximately 80~100° C. generated at a time when a part of the electron beam 5 collides with the shadow mask 8 when a power source is applied to the cathode ray tube.

By the doming effect of the shadow mask 8, the electron beam passing holes 15 of the shadow mask 8 are displaced. According to this, a landing position of the electron beam 5 is changed by ΔA, and by the mis-landing of the electron beam 5*a*, a color purity of a screen is deteriorated.

In the meantime, as shown in FIG. 4, the doming effect of the shadow mask 8 by heat expansion of the mask frame 9 is generated as collision heat of the electron beam 5 is transmitted to the mask frame 9 to expand the mask frame 9, and the expanded mask frame 9*b* pulls the shadow mask 8*a*.

Accordingly, a curved surface of the shadow mask 8*b* is changed to displace the electron beam passing holes 15, so that the landing position of the electron beam 5 is displaced by ΔB and a mis-landing in which the electron beam 5*b* does not land to a proper fluorescent surface 13 is generated, thereby deteriorating a color purity of a screen.

As shown in FIG. 5, amount of the mis-landing ΔB generated by the doming effect by the heat expansion of the mask frame 9 is greater than that ΔA generated by the doming effect by the heat expansion of the shadow mask 8, and directions of the mis-landing are different.

Also, the mis-landing ΔA by the heat expansion of the mask frame 9 is for a longer time than the time of the mis-landing ΔB by the heat expansion of the shadow mask 8.

That is, the doming effect of the shadow mask 8 by heat expansion of the mask frame 9 influences a color purity of a screen to a greater degree than the doming effect by heat expansion of the shadow mask 8.

The doming effect of the shadow mask 8 by the heat expansion of the mask frame 9 is generated as the heat-expanded mask frame 9 pulls the skirt portion 21 of the shadow mask 8. As shown in FIG. 6, a part to which a tensile force of the mask frame 9 is applied is near the welding point 25 of the mask frame 9 and the shadow mask 8 (an oblique line part), and a direction of the tensile force of the mask frame 9 is equal to that of an arrow.

In the meantime, in order to attenuate the tensile force, notches 23 are formed at both sides of the welding point 25 of the skirt portion 21 to reduce an influence of the tensile force on the entire skirt portion 21.

However, in accordance with that effort, as the size of a cathode ray tube becomes larger, a size of the shadow mask and the mask frame also becomes larger. According to this, the tensile force by the heat expansion of the shadow mask and the mask frame becomes great, thereby having a limited ability to attenuate the tensile force only by the notches. Therefore, a technique to attenuate the tensile force generated near the welding points of the skirt portion of the shadow mask is required.

SUMMARY OF THE INVENTION

Therefore, an object of the present invention is to provide a cathode ray tube in which a slot is formed between welding points by which a shadow mask is welded to a mask frame to disperse a tensile force generated near the welding points of the shadow mask by heat expansion of the mask frame, thereby reducing a doming effect by which the shadow mask is distorted, reducing a mis-landing by which an electron beam does not land to a proper fluorescent surface, and thus preventing a color purity of a screen from being deteriorated.

To achieve these and other advantages and in accordance with the purpose of the present invention, as embodied and broadly described herein, there is provided a cathode ray tube comprising: a panel; a funnel engaged to the panel for forming a vacuous space; and a shadow mask supported in the cathode ray tube by being fixed to a mask frame and including an effective surface having a plurality of electron beam passing holes at a center thereof, an ineffective surface formed at a periphery of the effective surface and not having the electron beam passing holes and a skirt portion extended from the ineffective surface towards a vertical direction thereof and welded to the mask frame. In the cathode ray tube, a slot of a predetermined size is formed between welding points by which the skirt portion is welded to the mask frame, and a height of the slot from an end of the skirt portion is higher than a height of the welding points.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A cathode ray tube according to the present invention will be explained with reference to attached drawings.

As aforementioned, the doming effect of the shadow mask of the cathode ray tube is generated by heat expansion of the shadow mask or the mask frame.

The doming effect by heat expansion of the shadow mask is performed for about 2 minutes after a power source is applied to the cathode ray tube, and has a lesser influence on a color purity of a screen.

However, the doming effect by heat expansion of the mask frame has a greater scale than the doming effect by heat expansion of the shadow mask and has a duration of about 25 minutes from about 2 minutes after a power source is applied to the cathode ray tube, thereby altering landing points of the electron beam which existed at the time of fabricating the cathode ray tube and, influencing a color purity of a screen.

The doming effect by heat expansion of the mask frame 9 is generated as the heat-expanded mask frame pulls the skirt portion of the shadow mask, and a part to which a tensile force is applied is a welding point between the mask frame and the shadow mask.

Accordingly, in the present invention, a slot having a predetermined size is formed so that the tensile force can be respectively dispersed to the welding points, and the tensile force generated at the welding points by heat expansion of the mask frame is induced not to influence an upper side of the skirt portion, that is, an effective surface side where a plurality of electron beam passing holes are formed, thereby reducing the doming effect of the shadow mask by heat expansion of the mask frame.

Figure 1:
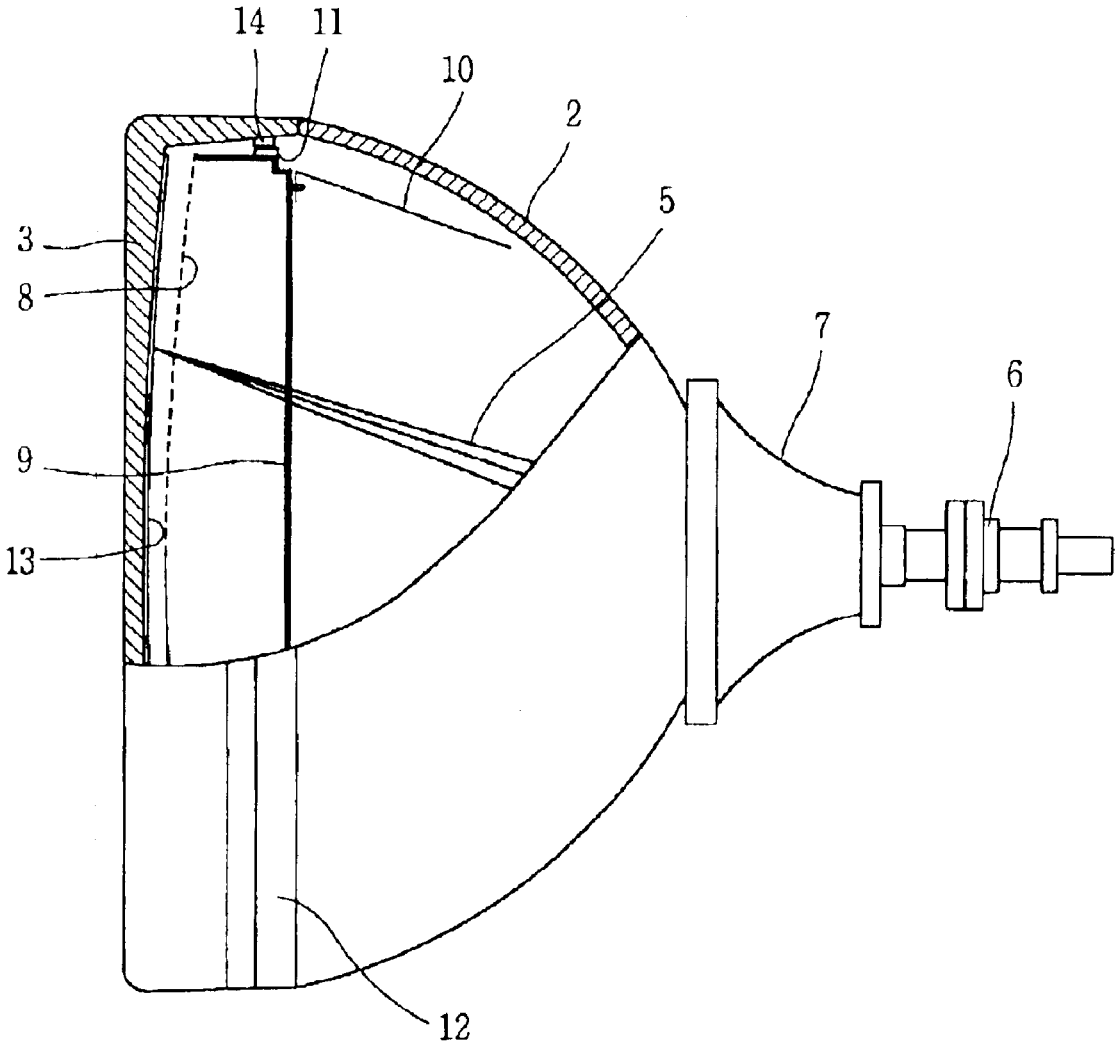
FIG. 1 CONVENTIONAL ART
FIG. 1 is a schematic view showing one embodiment of a cathode ray tube.
Figure 2:
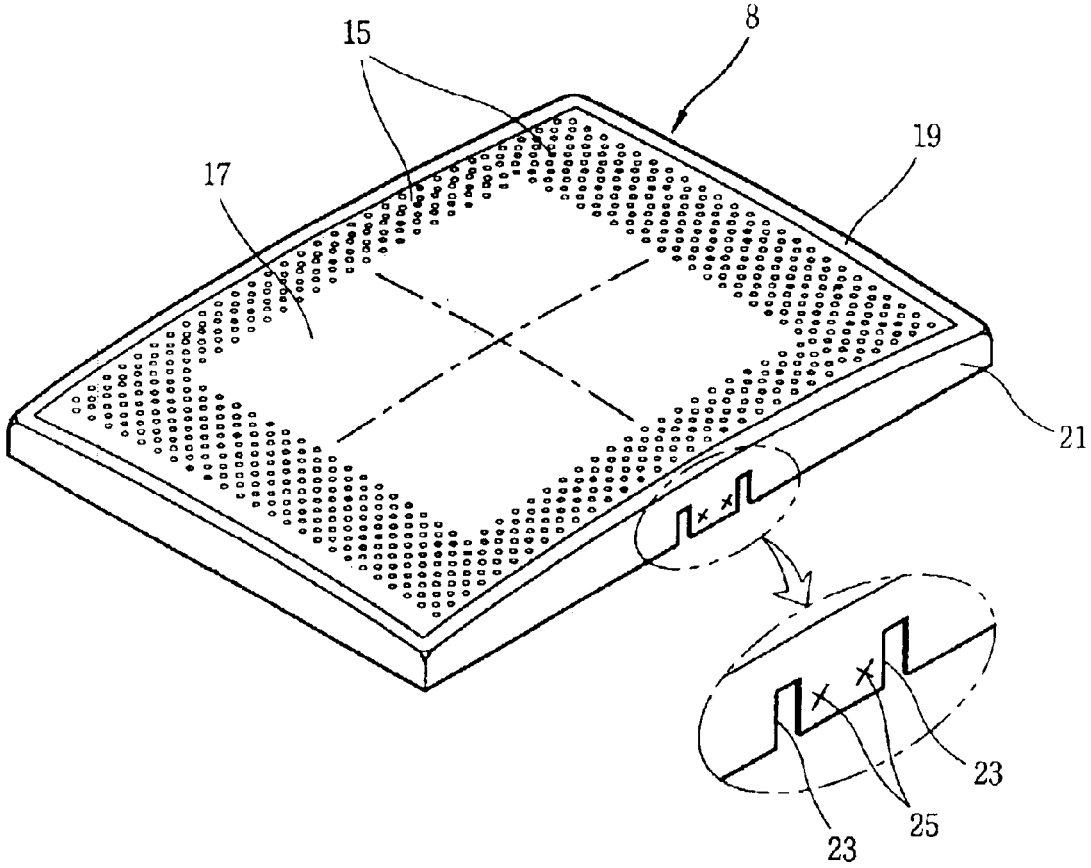
FIG. 2 CONVENTIONAL ART
FIG. 2 is a perspective view illustrating a shadow mask of the cathode ray tube in accordance with a conventional art.
Figure 3:
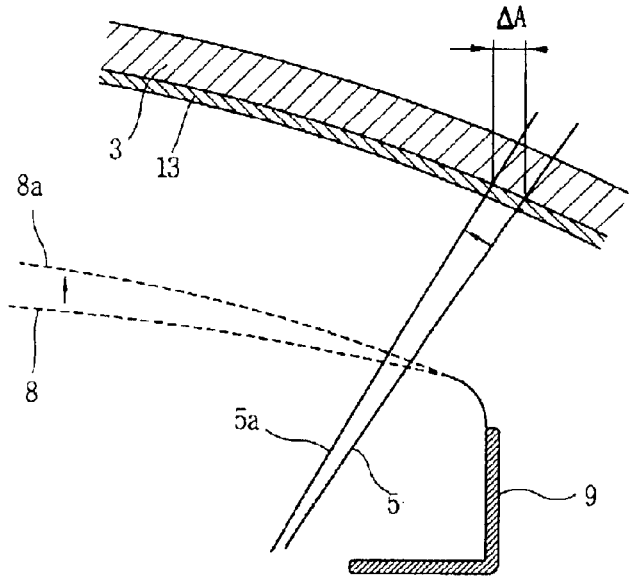
FIG. 3 CONVENTIONAL ART
FIG. 3 shows a doming effect of a shadow mask by heat expansion of the shadow mask of the cathode ray tube in accordance with the conventional art.
Figure 4:
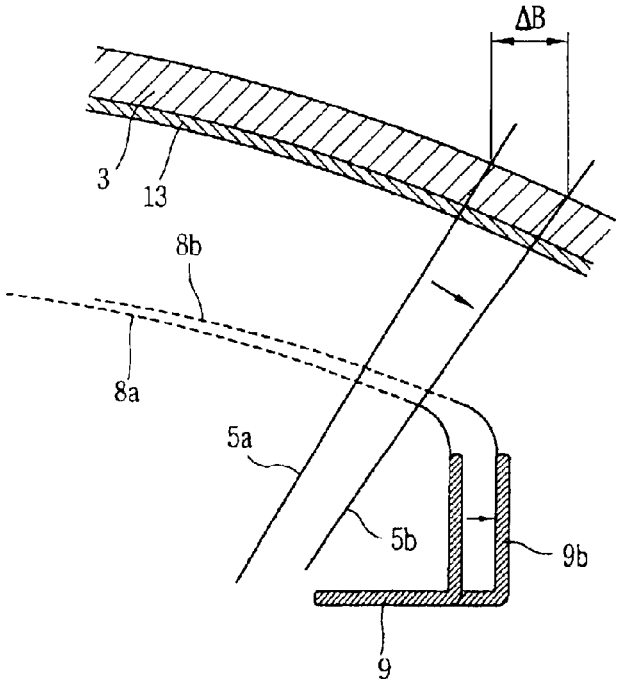
FIG. 4 CONVENTIONAL ART
FIG. 4 shows a doming effect of a shadow mask by heat expansion of a mask frame of the cathode ray tube in accordance with the conventional art.
Figure 5:
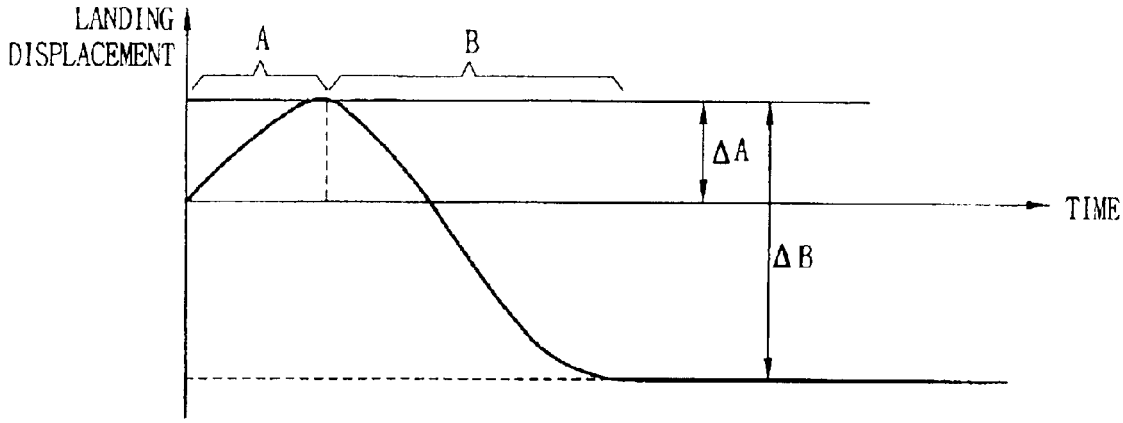
FIG. 5 CONVENTIONAL ART
FIG. 5 is a graph showing a landing displacement of an electron beam by the doming effect of the shadow mask of the cathode ray tube in accordance with the conventional art.
Figure 6:
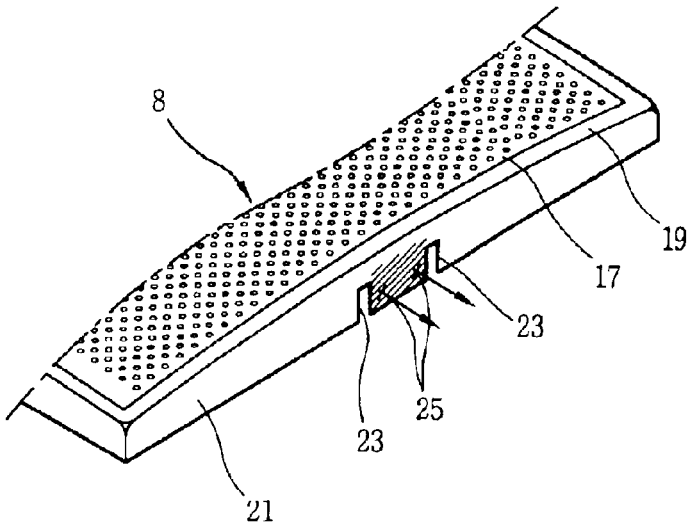
FIG. 6 CONVENTIONAL ART
FIG. 6 is a partial perspective view of the shadow mask showing a part which influences the shadow mask when the mask frame of the cathode ray tube is heat-expanded in accordance with the conventional art.
Figure 7:
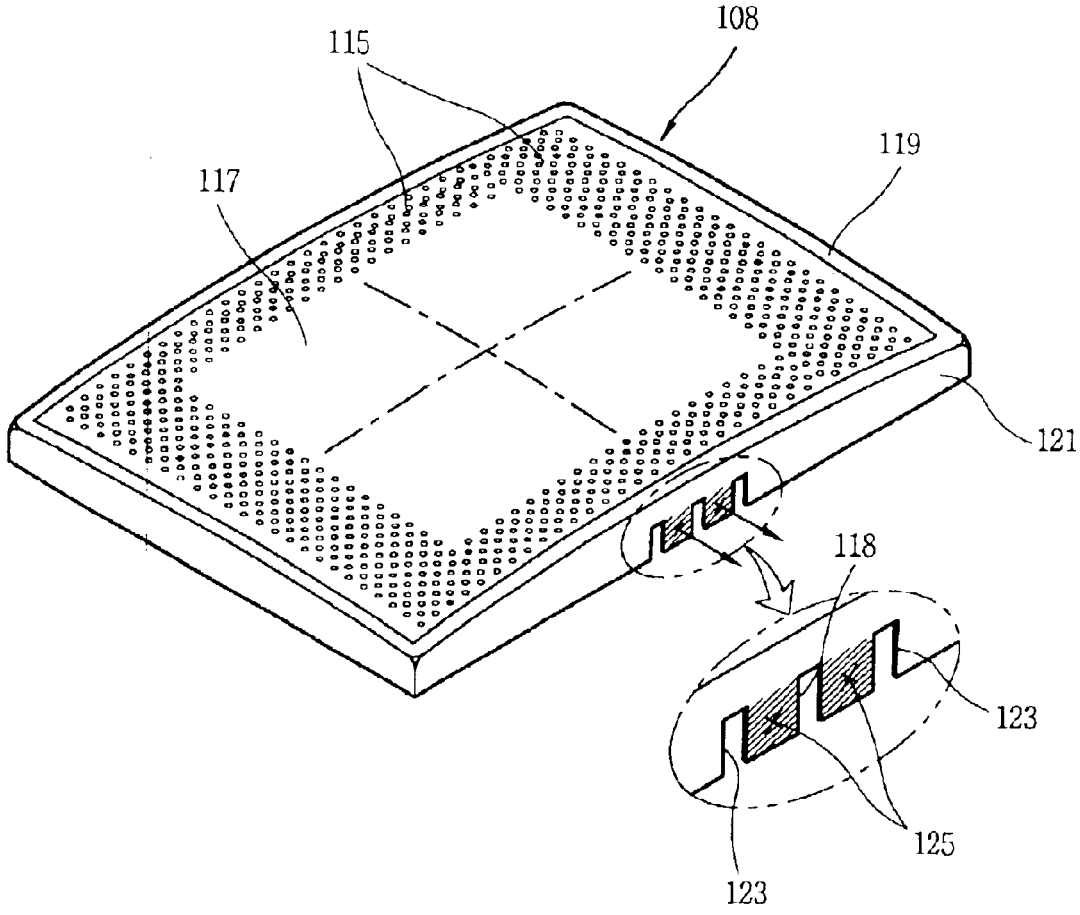
FIG. 7 is a perspective view showing the shadow mask of the cathode ray tube according to one embodiment of the present invention.
Figure 8:
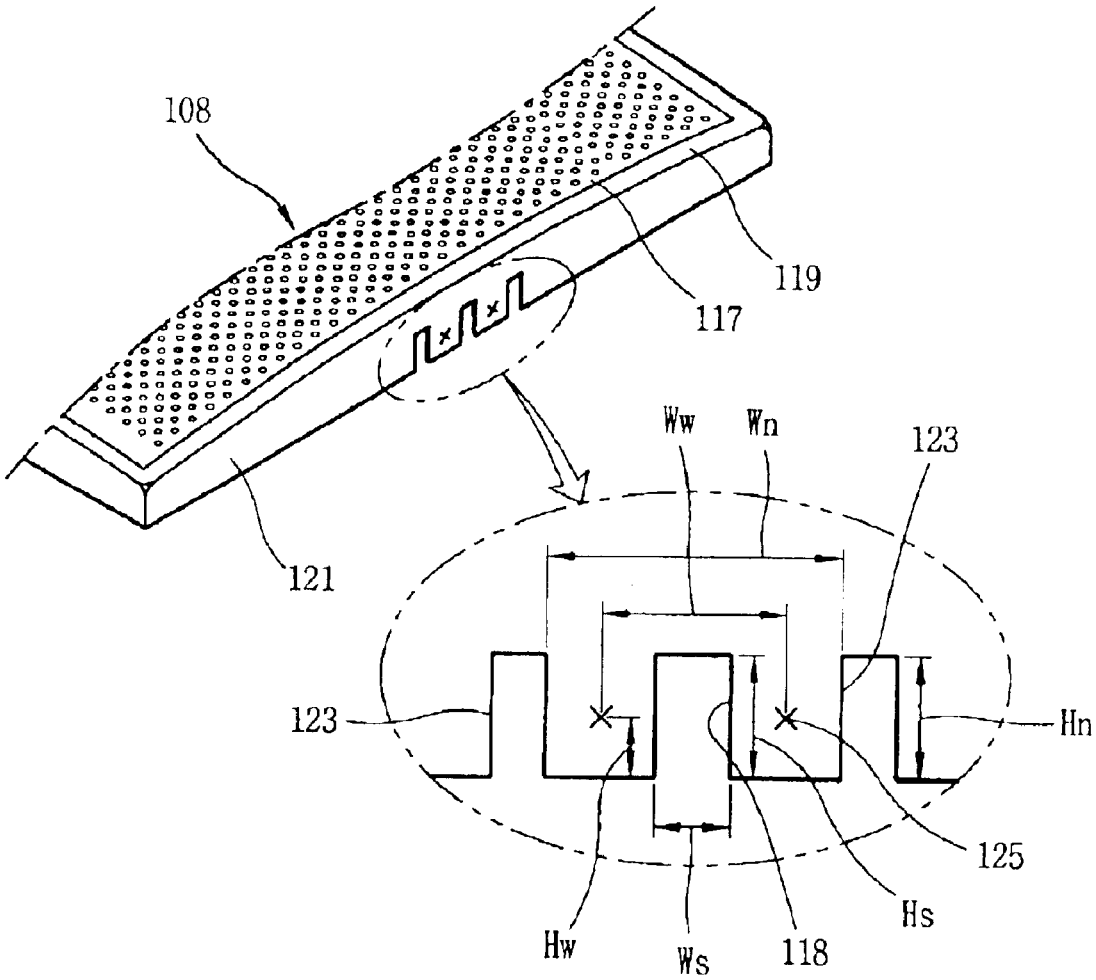
FIG. 8 is a partial perspective view showing the shadow mask of the cathode ray tube according to one embodiment of the present invention.

As shown in FIGS. 7 and 8, the shadow mask 108 of the cathode ray tube according to one embodiment of the present invention is a color selection device arranged with a predetermined interval from a panel formed to have a flat outer surface and an inner surface of a predetermined curvature, in which an electron beam emitted from an electron gun selectively strikes a fluorescent surface. The shadow mask comprises: an effective surface 117 having a plurality of electron beam passing holes 115 at a center thereof; an ineffective surface 119 formed at a periphery of the effective surface 117 and not having the electron beam passing holes 115; and a skirt portion 121 extended from the ineffective surface 119 towards a vertical direction thereof and fixed to the mask frame.

The shadow mask 108 is fixed-supported as the skirt portion 121 is point-welded to the mask frame, and the welding points 125 are located at middle portions of the long side portion and the short side portion of the skirt portion 121. Also, notches 123 are formed at both sides of the welding points 125 to prevent the tensile force generated at the welding points 125 from influencing the entire skirt portion 121.

Also, a slot 118 which respectively disperses the tensile force into two welding points 125 is formed to reduce an influence of the tensile force applied at the welding points 125 on the upper side of the skirt portion 121. The slot 118 is preferably formed to have a height Hs from the end of the skirt portion 121 higher than that Hw of the welding points 125.

$$Hw<Hs \quad (1)$$

The reason is as follows. If the height Hs of the slot 118 is lower than that Hw of the welding points 125, the tensile force applied at the welding points 125 is not dispersed but applied to the two welding points 125 at the same time, thereby not improving the doming effect.

Also, the skirt portion 121 is elastically distorted with a width which is wider towards outside by the tensile force applied to the welding points 125. Herein, in order to reduce an influence of the tensile force on the entire skirt portion 121, the height Hs of the slot 118 is preferably formed to be equal to that Hn of the notch 123 or lower than that Hn of the notch 123.

$$Hs \leqq Hn \quad (2)$$

In the meantime, a width Ws of the slot 118 is relevant to a distance Ww between the welding points 125 and a distance Wn between the notches. In order to maximize the dispersion effect of the tensile force generated at the welding points 125, it is preferable that the slot 118 is formed near the welding points 125. However, if the slot 118 is formed too near the welding points 125, a size of a region where the welding points 125 are located is reduced, so that a supporting intensity of the shadow mask 108 can be lowered and the width Ws of the slot 118 becomes large, thereby distorting the slot 118.

Accordingly, the width Ws of the slot 118 is required to have a proper value, and as a result of a test, in order to get a decrease of the doming effect to an optimum state, a proportion of the width Ws of the slot 118 for the distance Wn of the notches 123 is preferably formed in a range of 0.22~0.57.

$$0.22 \leqq Ws/Wn \leqq 0.57 \quad (3)$$

Also, in a state in which the decrease effect of the doming effect is optimum, a proportion of the width Ws of the slot 118 for the distance Ww between the welding points 125 is formed in a range of 0.34–0.87.

$$0.34 \leqq Ws/Ww \leqq 0.87 \quad (4)$$

Figure 9:
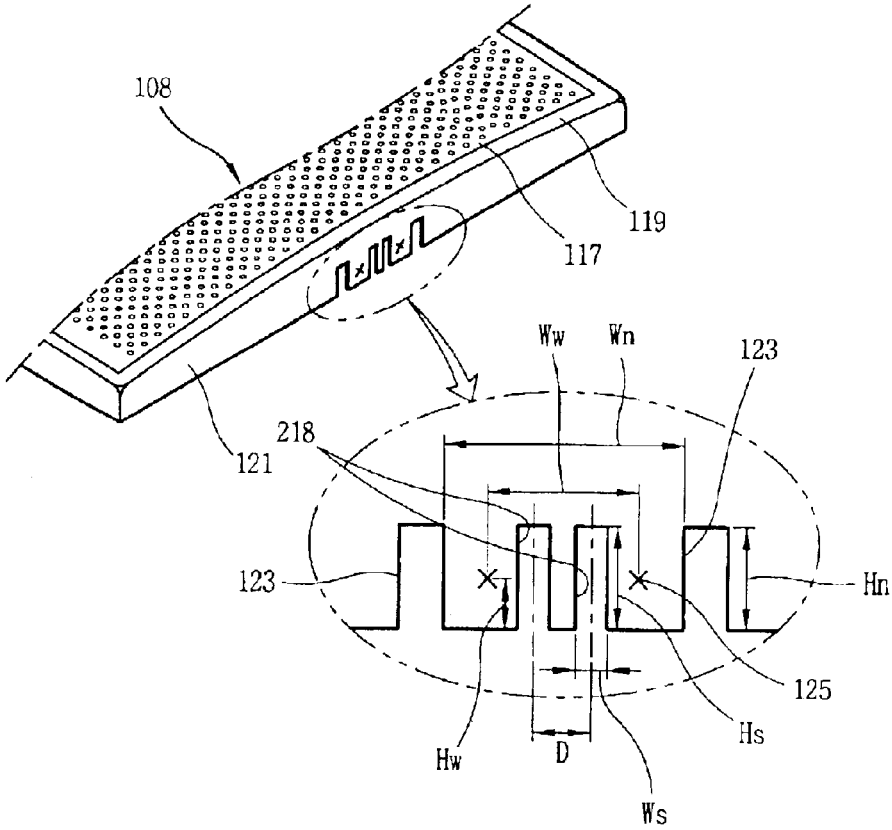
FIG. 9 is a partial perspective view showing the shadow mask of the cathode ray tube according to another embodiment of the present invention.

In one embodiment of the present invention, one slot is formed between the welding points, but as shown in FIG. 9, two or more than two slots can be formed between the welding points as another embodiment.

Herein, a distance D between the two slots 218 formed between the welding points 125 is larger than 0 and smaller than amount which an entire width of the slot 118 (width Ws of one slot×the number X of the slots) is deducted from the width Ww between the welding points 125.

$$0 \leqq D \leqq (Ww-(Ws \times X)) \quad (5)$$

In the shadow mask 108 of the cathode ray tube according to the present invention, the slot having a predetermined height and a width between the welding points 125 is formed to reduce the doming effect of the shadow mask, thereby reducing a mis-landing amount (ΔB) of the electron beam. The reducing effect of the mis-landing amount (ΔB) will be explained by comparing with the conventional art.

Figure 10:
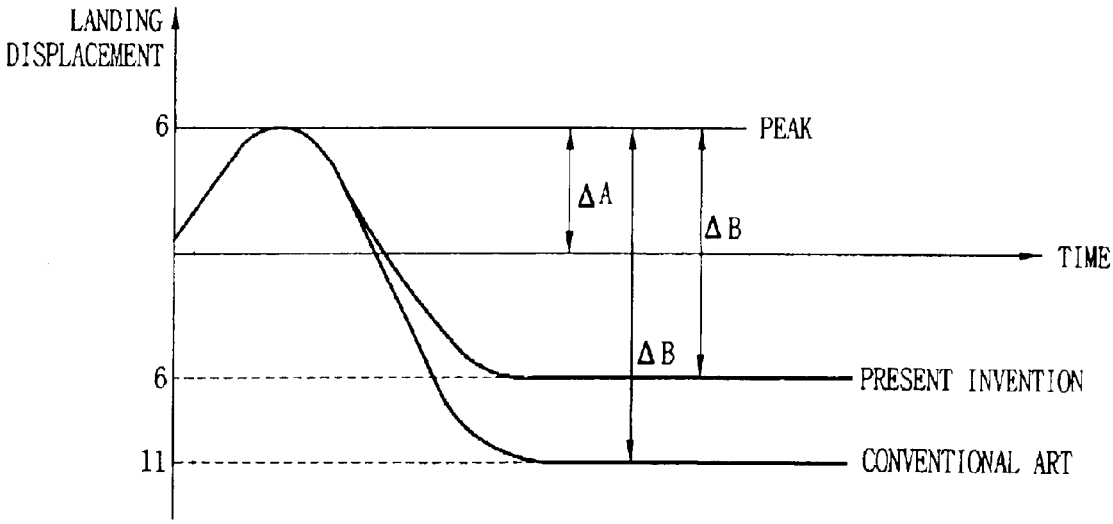
FIG. 10 is a graph illustrating a comparison of a landing displacement of the electron beam according to the present invention with that of the conventional art.

A following table 1 and FIG. 10 show the mis-landing amount (ΔB) generated at the shadow mask of the cathode ray tube according to the present invention in which the slot is formed between the welding points and the mis-landing amount (ΔB) of the shadow mask according to the conventional art in which the slot is not formed between the welding points. Herein, the mis-landing amount (ΔB) of the conventional art is 17 μm and the mis-landing amount (ΔB) of the present invention is 12 μm which is reduced by 5 μm.

TABLE 1

| | Landing Displacement | | |
|---|---|---|---|
| | ΔA (μm) | ΔB-ΔA(μm) | ΔB (μm) |
| Conventional Art | 6 | 11 | 17 |
| Present Invention | 6 | 6 | 12 |

That is, in the conventional shadow mask, the slot is not formed between the welding points, so that the tensile force of the skirt portion by heat expansion of the mask frame generated as collision heat of the electron beam is applied to the two welding points at the same time to increase the doming effect.

On the contrary, in the shadow mask of the present invention, the slot is provided between the welding points welded to the mask frame, so that the tensile force of the skirt portion by heat expansion of the mask frame is dispersed into the two welding points respectively to decrease the doming effect of the shadow mask.

In the cathode ray tube according to the present invention, the slot is provided between the welding points, so that the tensile force of the skirt portion by heat expansion of the mask frame is dispersed into the two welding points respectively to decrease the doming effect of the shadow mask. According to this, the mis-landing which the electron beam does not land to a precise landing point is reduced and a color purity of a screen can be prevented from being deteriorated.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A cathode ray tube comprising:

a panel;

a funnel engaged to the panel for forming a vacuous space; and a shadow mask supported in the cathode ray tube by being fixed to a mask frame and including an effective surface having a plurality of electron beam passing holes at a center thereof, an ineffective surface formed at a periphery of the effective surface and not having the electron beam passing holes and a skirt portion extended from the ineffective surface and welded to the mask frame, wherein the skirt portion of the shadow mask includes a slot formed between at least two welding points by which the skirt portion is welded to the mask frame, and a plurality of notches formed at peripheries of the welding points;

a height of the slot from an end side of the skirt portion is higher than that of the welding point; and a ratio of a width Ws of the slot to a distance Wn between the notches satisfies a formula of $0.22 \leqq Ws/Wn \leqq 0.57$.

2. The cathode ray tube of claim 1, wherein the following formula is satisfied:

$Hs \leqq Hn$, wherein Hs denotes a height of the slot from an end of the skirt portion and Hn denotes a height of the notch.

3. The cathode ray tube of claim 2, wherein the plurality of notches are formed at an outer side of the welding points.

4. The cathode ray tube of claim 1, wherein a following formula is satisfied: $0.34 \leqq Ws/Ww \leqq 0.87$, wherein Ws denotes a width of the slot and Ww denotes a distance between the welding points.

5. The cathode ray tube of claim 1, wherein a number of said slots is more than two.

6. The cathode ray tube of claim 5, wherein the following formula is satisfied: $0 \leqq D(Ww-(Ws \times X))$, wherein Ww denotes a distance between the welding points, Ws denotes a width of the slot, X denotes the number of the slots, and D denotes a distance between the slots.

7. The cathode ray tube of claim 1, wherein the panel has a substantially flat outer surface and an inner surface of a predetermined curvature.

8. The cathode ray tube of claim 1, wherein the electron beam passing holes of the shadow masks are formed as circular apertures.

9. The cathode ray tube of claim 1, wherein the plurality of notches are formed in a central portion of a short side of said skirt portion.

10. The cathode ray tube of claim 9, wherein the height of the slot is substantially equal to a height of said notches.

* * * * *